US012173911B2

(12) United States Patent
Taras et al.

(10) Patent No.: US 12,173,911 B2
(45) **Date of Patent: *Dec. 24, 2024**

(54) HEAT EXCHANGER FOR A HEATING, VENTILATION, AND AIR-CONDITIONING SYSTEM

(71) Applicant: Goodman Global Group, Inc., Waller, TX (US)

(72) Inventors: Michael F. Taras, The Woodlands, TX (US); Ying Gong, Fulshear, TX (US); Khaled H. Saleh, Katy, TX (US)

(73) Assignee: Goodman Global Group, Inc., Waller, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/217,155

(22) Filed: Jun. 30, 2023

(65) Prior Publication Data

US 2023/0341135 A1 Oct. 26, 2023

Related U.S. Application Data

(63) Continuation of application No. 17/303,314, filed on May 26, 2021, now Pat. No. 11,725,833.

(60) Provisional application No. 63/036,669, filed on Jun. 9, 2020.

(51) Int. Cl.

| | |
|---|---|
| ***F28F 9/00*** | (2006.01) |
| ***F24F 1/0067*** | (2019.01) |
| ***F28F 9/02*** | (2006.01) |

(52) U.S. Cl.
CPC ..... *F24F 1/0067* (2019.02); *F28F 9/0282* (2013.01); *F28F 2260/02* (2013.01)

(58) Field of Classification Search
CPC ..... F28D 1/05391; F28D 2021/0068; F28D 1/05383; F28D 1/05375; F28F 9/02; F28F 9/0209; F28F 9/0282; F28F 2260/02; F24F 1/0067; F24F 1/18
See application file for complete search history.

(56) References Cited

U.S. PATENT DOCUMENTS

| | | | | |
|---|---|---|---|---|
| 11,725,833 | B2 * | 8/2023 | Taras | F28D 1/05391 165/173 |
| 2015/0226489 | A1 | 8/2015 | Higashiiue | |

FOREIGN PATENT DOCUMENTS

| | | | | |
|---|---|---|---|---|
| EP | 1410929 | A2 * | 4/2004 | B60H 1/00328 |
| EP | 3587979 | A1 | 1/2020 | |
| JP | 2015034669 | A | 2/2015 | |
| JP | 2015230129 | A | 12/2015 | |

* cited by examiner

*Primary Examiner* — Harry E Arant
(74) *Attorney, Agent, or Firm* — K&L Gates LLP

(57) ABSTRACT

A heat exchanger for receiving an airflow having an uneven intensity distribution across the heat exchanger and for flowing refrigerant within the heat exchanger. The heat exchanger includes sections of microchannel tubes for flowing refrigerant through at least one pass through the heat exchanger, wherein the sections are configured according to the airflow across the heat exchanger. The heat exchanger may be used in an HVAC system. A method may also be performed to manufacture the heat exchanger.

20 Claims, 5 Drawing Sheets

HEAT EXCHANGER FOR A HEATING, VENTILATION, AND AIR-CONDITIONING SYSTEM

BACKGROUND

This section is intended to provide relevant background information to facilitate a better understanding of the various aspects of the described embodiments. Accordingly, these statements are to be read in this light and not as admissions of prior art.

In general, heating, ventilation, and air-conditioning ("HVAC") systems circulate an indoor space's air over low-temperature (for cooling) or high-temperature (for heating) sources, thereby adjusting an indoor space's ambient air temperature. HVAC systems generate these low- and high-temperature sources by, among other techniques, taking advantage of a well-known physical principle: a fluid transitioning from gas to liquid releases heat, while a fluid transitioning from liquid to gas absorbs heat.

Within a typical HVAC system, a fluid refrigerant circulates through a closed loop of tubing that uses a compressor, which receive DC power from an inverter, and flow-control devices to manipulate the refrigerant's flow and pressure, causing the refrigerant to cycle between the liquid and gas phases. Generally, these phase transitions occur within the HVAC system heat exchangers, which are part of the closed loop and designed to transfer heat between the circulating refrigerant and flowing ambient air. As would be expected, the heat exchanger providing heating or cooling to the climate-controlled space or structure is described adjectivally as being "indoors," and the heat exchanger transferring heat with the surrounding outdoor environment is described as being "outdoors."

The refrigerant circulating between the indoor and outdoor heat exchangers-transitioning between phases along the way-absorbs heat from one location and releases it to the other. Those in the HVAC industry describe this cycle of absorbing and releasing heat as "pumping." To cool the climate-controlled indoor space, heat is "pumped" from the indoor side to the outdoor side, and the indoor space is heated by doing the opposite, pumping heat from the outdoors to the indoors.

BRIEF DESCRIPTION OF THE DRAWINGS

Embodiments of the HVAC system are described with reference to the following figures. The same numbers are used throughout the figures to reference like features and components. The features depicted in the figures are not necessarily shown to scale. Certain features of the embodiments may be shown exaggerated in scale or in somewhat schematic form, and some details of elements may not be shown in the interest of clarity and conciseness.

DETAILED DESCRIPTION

The present disclosure describes a heat exchanger for receiving an airflow distribution having an uneven airflow intensity across the heat exchanger and for flowing refrigerant within the heat exchanger. The heat exchanger includes a plurality of tubes that each include a number of microchannels for flowing refrigerant from one side of the heat exchanger to the other, which is considered one pass across the heat exchanger. The fluid may only make one pass across the heat exchanger and thus only one stage. However, the fluid may make multiple passes across the heat exchanger, with each successive pass being a different stage. One or more tubes that flow fluid in a given direction across the heat exchanger at the same stage in the flow circuit can be grouped together into a section. All of the tubes that flow refrigerant in the same direction at the same stage need not be adjacent each other and instead may be spaced apart into non-adjacent sections of tubes. The tubes may also be separated by fins therebetween.

In the microchannel heat exchanger, the sections of tubes are designed based on an uneven airflow distribution across the heat exchanger. In particular, the sections are configured according to the intensity of the uneven airflow distribution across the heat exchanger at different locations as well as between the tubes. The configuration may involve various aspects of the sections, such as the number of tubes in each section, the heat transfer surface geometries of the tubes in the heat exchanger sections, the total number of sections of tubes, whether the heat exchanger sections in a stage are adjacent, the total volume for fluid flow within a section, and the total number of pass stages. The configuration of the sections is designed to increase the efficiency of the exchange of heat between the airflow and the refrigerant flow. Further, the configuration of the sections can minimize the negative effect of cross-conduction, that is, undesired exchange of heat between portions of the heat exchanger rather than with the airflow.

Figure 1:
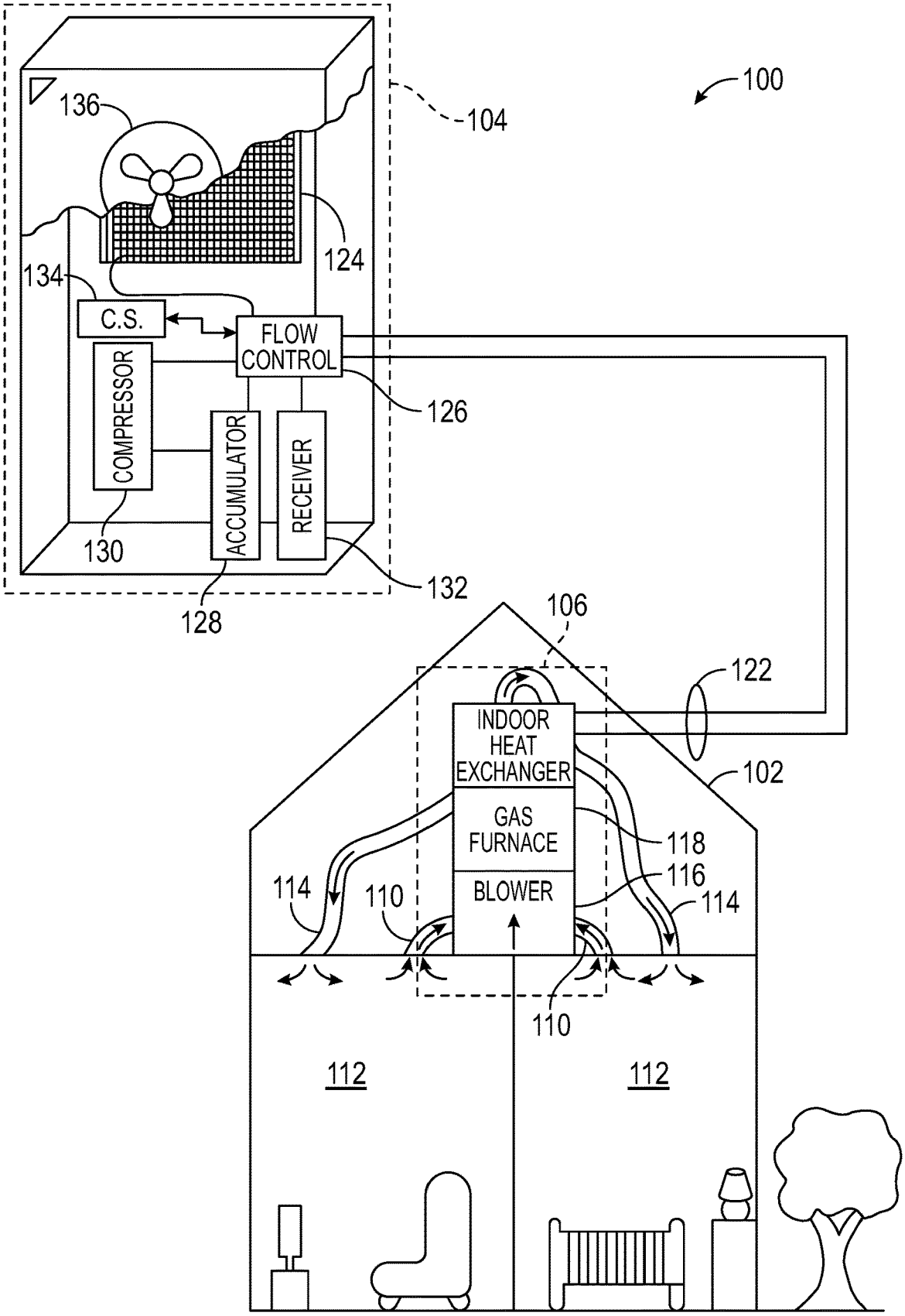
FIG. 1 is a block diagram of an HVAC system, according to one or more embodiments.

Turning now to the figures, FIG. 1 is an HVAC system 100 in accordance with one embodiment. As depicted, the HVAC system 100 provides heating and cooling for a residential structure 102. However, the concepts disclosed herein are applicable to numerous of heating and cooling situations, which include residential, industrial, and commercial settings.

The described HVAC system 100 divides into two primary portions: The outdoor unit 104, which mainly comprises components for transferring heat with the environment outside the structure 102; and the indoor unit 106, which mainly comprises components for transferring heat with the air inside the structure 102. To heat or cool the illustrated structure 102, the indoor unit 106 draws ambient indoor air via returns 110, passes that air over one or more heating/cooling elements (i.e., sources of heating or cooling), and then routes that conditioned air, whether heated or cooled, back to the various climate-controlled spaces 112 through ducts or ductworks 114—which are relatively large pipes that may be rigid or flexible. A blower 116 provides the motivational force to circulate the ambient air through the returns 110 and the ducts 114. Additionally, although a split system is shown in FIG. 1, the disclosed embodiments can be equally applied to the packaged or other types of system configurations.

As shown, the HVAC system 100 is a "dual-fuel" system that has multiple heating elements, such as an electric heating element or a gas furnace 118. The gas furnace 118 located downstream (in relation to airflow) of the blower 116 combusts natural gas to produce heat in furnace tubes (not shown) that coil through the gas furnace 118. These furnace tubes act as a heating element for the ambient indoor air being pushed out of the blower 116, over the furnace tubes, and into the ducts 114. However, the gas furnace 118 is generally operated when robust heating is desired. During conventional heating and cooling operations, air from the blower 116 is routed over an indoor heat exchanger 120 and into the ducts 114. The blower 116, the gas furnace 118, and the indoor heat exchanger 120 may be packaged as an integrated air handler unit, or those components may be modular. In other embodiments, the positions of the gas furnace 118, the indoor heat exchanger 120, and the blower 116 can be reversed or rearranged.

In at least one embodiment, the indoor heat exchanger 120 acts as a heating or cooling means that add or removes heat from the structure, respectively, by manipulating the pressure and flow of refrigerant circulating within and between the indoor and outdoor units via refrigerant lines 122. In another embodiment, the refrigerant could be circulated to only cool (i.e., extract heat from) the structure, with heating provided independently by another source, such as, but not limited to, the gas furnace 118. In other embodiments, there may be no heating of any kind. HVAC systems 100 that use refrigerant to both heat and cool the structure 102 are often described as heat pumps, while HVAC systems 100 that use refrigerant only for cooling are commonly described as air conditioners.

Whatever the state of the indoor heat exchanger 120 (i.e., absorbing or releasing heat), the outdoor heat exchanger 124 is in the opposite state. More specifically, if heating is desired, the illustrated indoor heat exchanger 120 acts as a condenser, aiding transition of the refrigerant from a high-pressure gas to a high-pressure liquid and releasing heat in the process. The outdoor heat exchanger 124 acts as an evaporator, aiding transition of the refrigerant from a low-pressure liquid to a low-pressure gas, thereby absorbing heat from the outdoor environment. If cooling is desired, the outdoor unit 104 has flow control devices 126 that reverse the flow of the refrigerant, allowing the outdoor heat exchanger 124 to act as a condenser and allowing the indoor heat exchanger 120 to act as an evaporator. The flow control devices 126 may also act as an expander to reduce the pressure of the refrigerant flowing therethrough. In other embodiments, the expander may be a separate device located in either the outdoor unit 104 or the indoor unit 106. To facilitate the exchange of heat between the ambient indoor air and the outdoor environment in the described HVAC system 100, the respective heat exchangers 120, 124 have tubing that winds or coils through heat-exchange surfaces, to increase the surface area of contact between the tubing and the surrounding air or environment.

The illustrated outdoor unit 104 may also include an accumulator 128 that helps prevent liquid refrigerant from reaching the inlet of a compressor 130. The outdoor unit 104 may include a receiver 132 that helps to maintain sufficient refrigerant charge distribution in the HVAC system 100. The size of these components is often defined by the amount of refrigerant employed by the HVAC system 100.

The compressor 130 receives low-pressure gas refrigerant from either the indoor heat exchanger 120 if cooling is desired or from the outdoor heat exchanger 124 if heating is desired. The compressor 130 then compresses the gas refrigerant to a higher pressure based on a compressor volume ratio, namely the ratio of a discharge volume, the volume of gas outputted from the compressor 130 once compressed, to a suction volume, the volume of gas inputted into the compressor 130 before compression. In the illustrated embodiment, the compressor is a multi-stage compressor 130 that can transition between at least two volume ratios depending on whether heating or cooling is desired. In other embodiments, the HVAC system 100 may be configured to only cool or only heat, and the compressor 130 may be a single stage compressor having only a single volume ratio.

The compressor 130 receives electrical power from a control system 134 that includes an inverter system, as described in more detail below with reference to FIG. 2, which converts the AC power received by the HVAC system 100 to DC power for use by the compressor 130. The control system 134 controls the speed of the compressor 130, as well as the switching between compressor stages for multi-stage compressors, based on the required heating or cooling that must be provided by the HVAC system, i.e., the load on the HVAC system 100. In some embodiments, the control system may also control the speed of a fan 136 that blows air across the heat exchanger 124.

Figure 2:
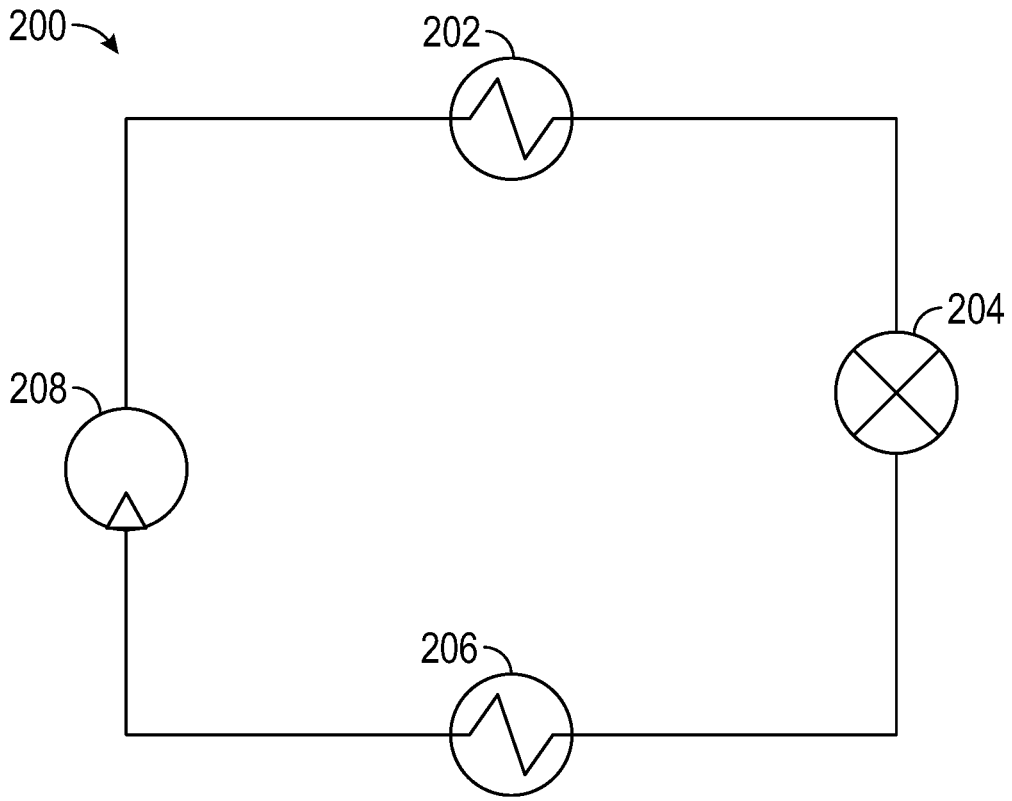
FIG. 2 is a simplified block diagram of an HVAC system 200, according to one or more embodiments.

Referring now to FIG. 2, FIG. 2 is a simplified block diagram of an HVAC system 200. The HVAC system 200 includes a first heat exchanger 202, an expansion device 204, a second heat exchanger 206, and a compressor 208. Additionally, the heat exchangers 202, 206 may be either indoor or outdoor heat exchangers, depending on the configuration of the HVAC system 200. The HVAC system 200 may also include the equipment shown in FIG. 1 and function as discussed above with reference to FIG. 1. Accordingly, the function of the first heat exchanger 202, the expansion device 204, the second heat exchanger 206, and the compressor 208 will not be discussed in detail except as necessary for the understanding of the HVAC system 200 shown in FIG. 2.

As shown in FIG. 2, high-pressure refrigerant flows from the compressor 208 to the first heat exchanger 202, where it is condensed. The high-pressure liquid refrigerant then flows to the expansion device 204, where it is expanded to low-pressure refrigerant. The low-pressure refrigerant is then evaporated in the second heat exchanger 206 and the low-pressure vapor flows into the compressor 208 as a vapor, to begin the cycle again.

Figure 3:
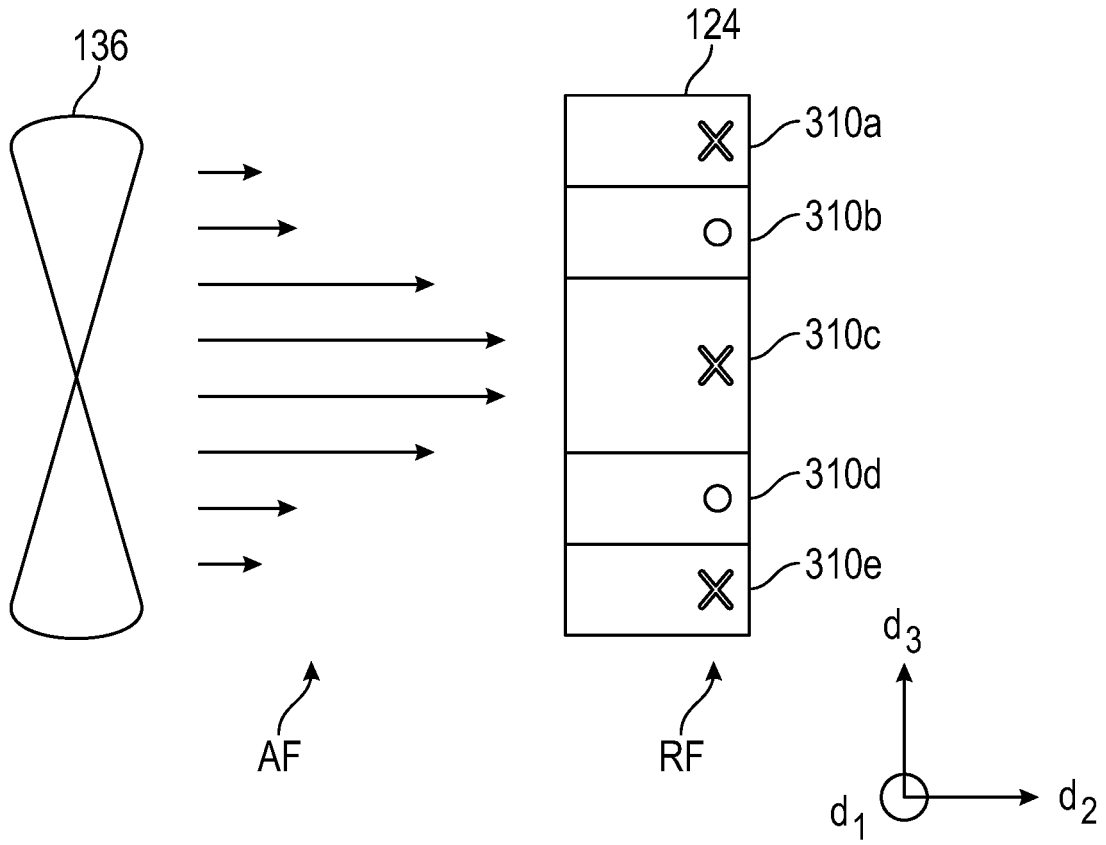
FIG. 3 is a block diagram of a fan and a multi-pass heat exchanger, according to one or more embodiments.
Figure 4:
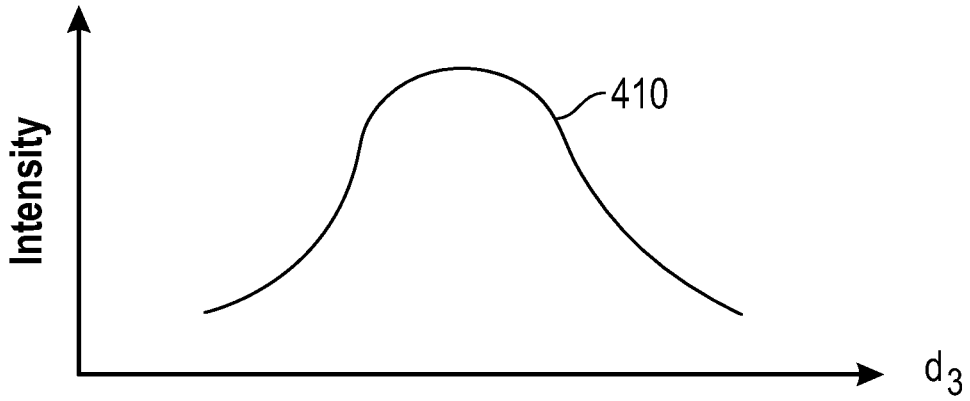
FIG. 4 is a schematic plot of the intensity of an uneven airflow distribution, according to one or more embodiments.

Referring now to FIGS. 3 and 4, FIG. 3 is a block diagram of a fan and a side view of a multi-pass microchannel heat exchanger 124 that can be used in an HVAC system, as described above, and FIG. 4 is a schematic plot of the airflow AF having an uneven intensity distribution that can occur in an HVAC system. Fan 136 is operable to generate the airflow AF having an uneven intensity distribution 410 across heat exchanger 124 as shown by arrows in FIG. 3, where the distribution varies in intensity along direction $d_3$ in FIGS. 3 and 4. The airflow AF may be of uneven intensity for different reasons. For example, fan 136 includes a plurality of fan blades and the uneven intensity distribution may be due to the orientations and/or geometries of the fan blades. It will be understood that while fan 136 is shown in a plane parallel to the heat exchanger 124, a fan operable to generate an uneven intensity distribution may be in an alternate arrangement to the heat exchanger, for example in a plane perpendicular to the heat exchanger. Further, it will be understood that the uneven airflow intensity may be due, alternatively or in combination, to the direction of airflow across the heat exchanger. Further, while fan 136 and heat exchanger 124 are shown in FIG. 1 where the heat exchanger is a condenser, a heat exchanger receiving an airflow distribution of uneven intensity may act as an alternate component of an HVAC system, for example an evaporator.

Figure 5:
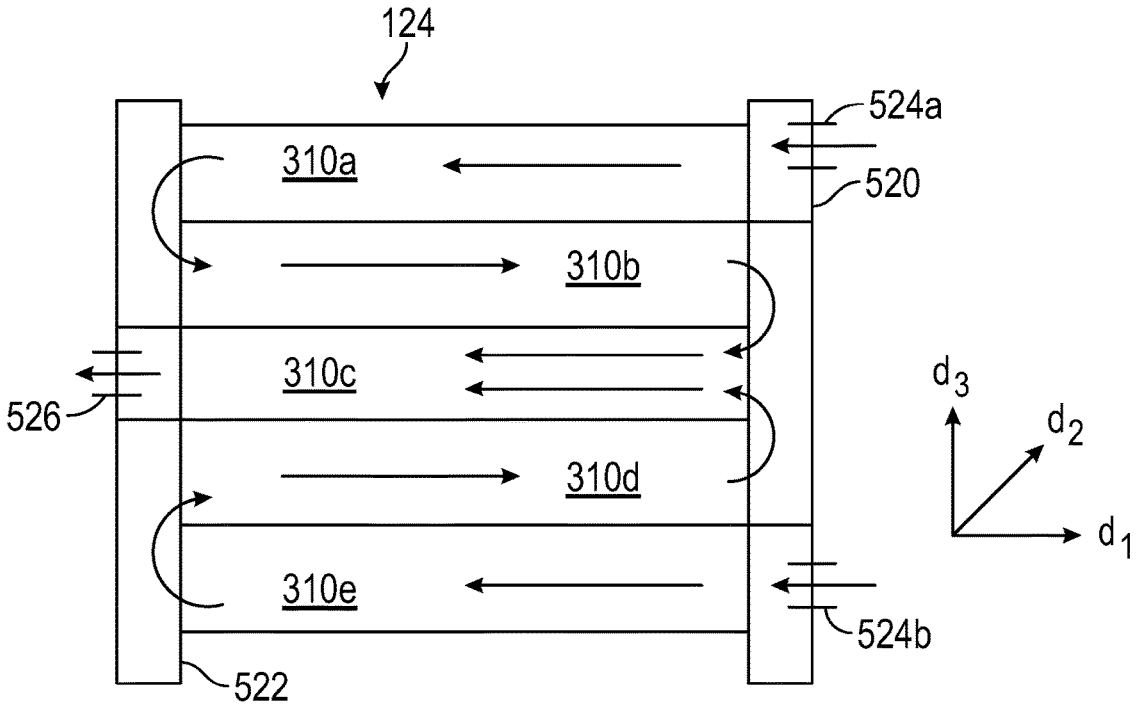
FIG. 5 is a block diagram of a heat exchanger, according to one or more embodiments.

Referring now to FIGS. 3 and 5, FIG. 5 is a block diagram of a front view of the heat exchanger 124 shown in FIG. 3. Heat exchanger 124 includes a plurality of heat exchanger sections 310*a*, 310*b*, 310*c*, 310*d*, 310*e* connected at each end to headers 520, 522. As shown in FIG. 3, an "x" indicates refrigerant flow in a direction into the page, towards negative $d_1$ direction and a circle indicates refrigerant flow in a direction out of the page, towards positive $d_1$, where $d_1$ is a direction in the coordinate system shown in FIG. 3. As explained above, a refrigerant pass is one passage of refrigerant from one header at one end of heat exchanger 124 to the opposing header at the opposing end of heat exchanger 124. For each pass, refrigerant flows through a section of a plurality of tubes that carry the refrigerant from an end of heat exchanger 124 to an opposing end of heat exchanger 124 for a given stage of the flow through the heat exchanger. There may be more than one section of tubes flowing fluid in the same direction at the same stage and the sections need not be adjacent. For example, as shown sections 310*a* and 310*e* flow fluid in the same direction at the same stage but are non-adjacent. Further, fluid from non-adjacent sections can be combined when transitioning to a new pass and thus new stage. For example, the fluid from sections 310*b* and 310*d* combine into the tubes of section 310*c* for the last pass. However, it will be appreciated that the fluid need not necessarily be combined before exiting the heat exchanger.

Still referring to FIG. 5, headers 520 and 522 are in fluid communication with sections 310*a*, 310*b*, 310*c*, 310*d*, and 310*e*. Header 520 includes inlets 524*a* and 524*b* for receiving refrigerant to heat exchanger 124. Header 522 includes outlet 526 for delivering refrigerant from heat exchanger 124. Section 310*c* is operable to receive refrigerant flow from sections 310*b* and 310*d*, which in turn are operable to receive refrigerant flow from sections 310*a* and 310*d*. Thus, the sections of tubes carry refrigerant from one of the headers 520 and 522 to the other of the headers 520 and 522. Headers 520 and 522 include separators or are otherwise divided to allow the flow of the refrigerant to change direction to proceed to the next stage as shown with the U-turn arrows in FIG. 5. It will be understood that while heat exchanger 124 is illustrated in FIGS. 3 and 5 as a three-pass heat exchanger (refrigerant from inlet to outlet makes three passes), alternate numbers of passes are contemplated, for example two, four, five, six, seven, eight, nine, ten, or more. Nor do the passes need to be the same for each inlet before the refrigerant exits the heat exchanger. Similarly, any number of sections, inlets, and outlets are also contemplated.

Figure 6:
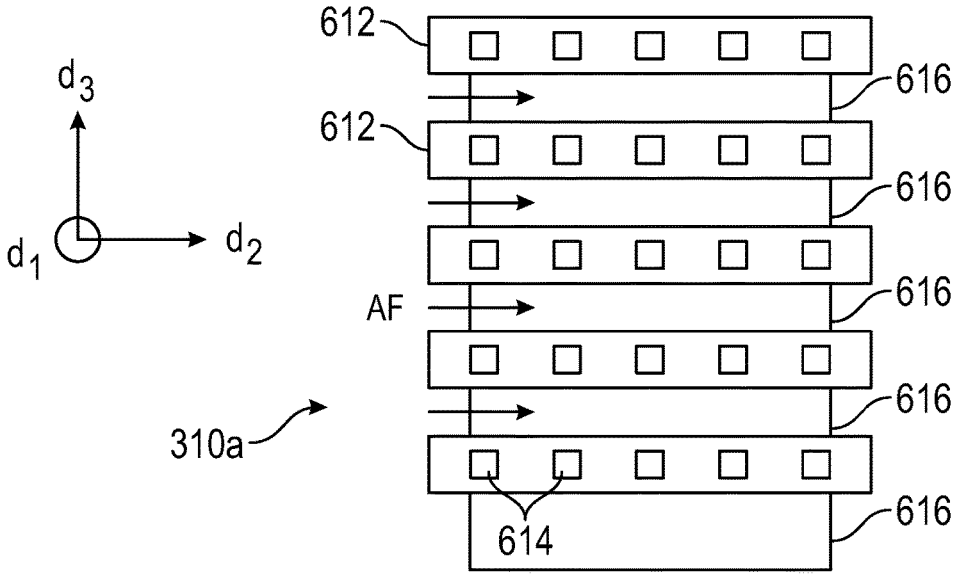
FIG. 6 is a block diagram of a section of tubes of a heat exchanger, according to one or more embodiments.

Referring now to FIGS. 3 and 6, FIG. 6 is an expanded block diagram of a cross sectional view of a heat exchanger section 310*a* shown in FIG. 3. Heat exchanger section 310*a* includes a plurality of tubes 612. Tubes 612 may be tubes known as flat tubes that are wider than high. Each tube 612 includes a plurality of microchannels 614 for carrying refrigerant. In microchannels 614, for heat exchanger section 310*a*, the direction of refrigerant flow is into the page in the direction $d_1$ (not shown). Tubes 612 are stacked, thus defining a size or volume of heat exchanger section 310*a* along direction in which the airflow is uneven, shown in FIGS. 3-6 as $d_3$. It will be understood that while tubes are shown "horizontally" stacked in FIG. 6, a heat exchanger may include tubes that are "vertically" stacked. A plurality of fins 616 are arranged between tubes 612. Heat exchanger section 310*a* in operation receives airflow AF across the fins between the tubes. The heat exchanger in operation exchanges heat between the airflow and the refrigerant flow. Heat exchanger sections 310*b*, 310*c*, 310*d*, 310*e* are composed likewise of tubes and fins (not shown).

Referring to FIGS. 3-6, the heat exchanger sections are configured according to the airflow intensity across each heat exchanger section 310*a*, 310*b*, 310*c*, 310*d*, 310*e* to match to the uneven airflow distribution 410. However, it will be understood that there may be alternative arrangements of sections than shown in FIGS. 3 and 5. For example, although there are five sections and all fluid goes through three passes, there may be more or fewer sections and passes in a heat exchanger. Further, all of the tubes in a section for a given stage may be adjacent. Further, the sections may include different numbers of tubes, even within the same stage if the stage is separated into non-adjacent sections. Also, although the number of sections, and thus passes, shown on either side of section 310*c* in FIG. 5 are symmetrical, there may instead be more sections on one side, e.g., four instead of two, of section 310*c* than the other. Further, the fluid need not be recombined for existing the heat exchanger and instead there may be two outlets similarly to there being two inlets and thus the separate fluid flows never combine. Further, there may be any number of passes, sections, inlets, and outlets for a heat exchanger.

As discussed, the heat exchanger sections are configured based on the uneven airflow distribution to increase the heat exchange in areas with increased airflow. Thus, as heat exchange can increase with an increase in refrigerant flow volume, the refrigerant volume of each heat exchanger section may be optimized based on the airflow intensity across each heat exchanger section rather than the same volume for the section. The refrigerant flow is driven by the pressure difference, which in turn is related to the heat transfer. The optimal heat exchanger design achieves substantially identical refrigerant exit states, where the exit state is defined for example by temperature and/or pressure, before the passes are combined. Further, the highest airflow is suited to a section where the temperature difference is low and the heat transfer benefits from a boost, for example a subcooling section in a condenser or a superheating section in an evaporator. The number of tubes in each heat exchanger section 310*a*, 310*b*, 310*c*, 310*d*, 310*e* may also depend on the airflow intensity across each heat exchanger section. Heat exchange increases with increasing the number of tubes. Changing the number of tubes in a section also changes the total cross-section area of the section and the amount of the refrigerant flown through the heat exchanger section. Heat exchanger sections 310*a*, 310*b*, 310*c*, 310*d*, 310*e* may further include different geometries of tubes 612 and/or fins 616 according to the airflow intensity across each heat exchanger section. Varying tube geometry may include varying one or more of tube density, cross sectional tube shape, tube width, tube height, number of microchannels, microchannel shape, or the like. Varying fin geometry may include varying one or more of fin density, fin height, number of louvers, louver angle, or the like.

Figure 7:
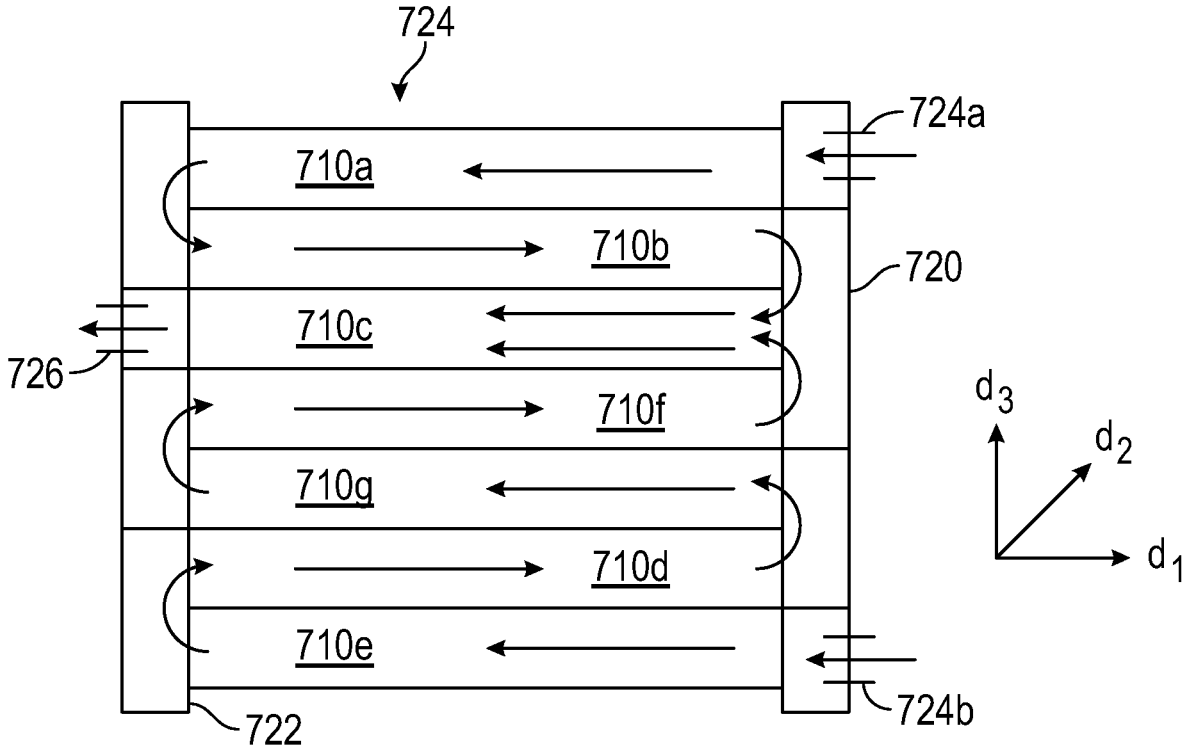
FIG. 7 is a block diagram of an alternative embodiment of a heat exchanger.

Referring now to FIG. 7, FIG. 7 is a block diagram of a front view of an alternative embodiment of a heat exchanger 724 that includes similar components as the heat exchanger 124 shown in FIG. 3. For example, heat exchanger 724 includes a plurality of heat exchanger sections 710*a-e* connected at each end to headers 720, 722. For each pass, refrigerant flows through a section of a plurality of tubes that carry the refrigerant from one end of heat exchanger 724 to an opposing end of heat exchanger 724 for a given stage of the flow through the heat exchanger. There may be more than one section of tubes flowing fluid in the same direction at the same stage and the sections need not be adjacent. For example, as shown sections 710*a* and 710*e* flow fluid in the same direction at the same stage but are non-adjacent.

Still referring to FIG. 7, headers 720 and 722 are in fluid communication with sections 710*a-e*. Header 720 includes inlets 724*a* and 724*b* for receiving refrigerant to heat exchanger 724. Header 722 includes outlet 726 for delivering refrigerant from heat exchanger 724. The sections of tubes carry refrigerant from one of the headers 720 and 722 to the other of the headers 720 and 722. Headers 720 and 722 include separators or are otherwise divided to allow the flow of the refrigerant to change direction to proceed to the next stage as shown with the U-turn arrows in FIG. 7. Unlike the three-pass heat exchanger 124 in FIG. 5 (refrigerant from inlet to outlet makes three passes), the heat exchanger 724 includes five passes with the inclusion of two additional sections 710*f* and 710*g* of tubes. As shown, the sections 710*f* and 710*g* are not symmetrical with respect to the inlets 724*a*, 724*b* and the outlet 726 but instead are not located between the inlet 724*b* and the outlet 726. Thus, the heat exchanger 724 includes additional individual sections for flowing refrigerant in additional passes each before flowing refrigerant into the third pass section 710*c* such that the number of sections and passes from one inlet 724*a* to the outlet 726 is different than the other inlet 724*b*. Section 710*c* is still operable to receive refrigerant flow from multiple sections, however section 710*c* receives flow from sections 710*b* and 710*f*. It will be understood that alternate numbers of passes are contemplated. Similarly, any number of sections, inlets, and outlets are also contemplated.

The heat exchanger sections 710 *a-g* are configured according to the airflow intensity across each heat exchanger section 710 *a-g* based on the uneven airflow distribution across the heat exchanger 724 and the airflow intensity across each section. It will be understood that there may be alternative arrangements of sections than shown in FIG. 7. For example, although there are seven sections and five passes, there may be more or fewer sections and passes in a heat exchanger. Further, all of the tubes in a section for a given stage may be adjacent. Further, the sections may include different numbers of tubes, even within the same stage if the stage is separated into non-adjacent sections. Further, the fluid need not be recombined for existing the heat exchanger and instead there may be two outlets similarly to there being two inlets and thus the separate fluid flows never combine.

Referring to FIG. 7, the heat exchanger sections are configured according to the airflow intensity across each heat exchanger section 710*a-g* to match to the uneven airflow distribution 410. However, it will be understood that there may be alternative arrangements of sections than shown in FIG. 7. For example, although there are seven sections, there may be more or fewer sections and passes in a heat exchanger. Further, the sections may include different numbers of tubes, even within the same stage if the stage is separated into non-adjacent sections. Further, the fluid need not be recombined for existing the heat exchanger and instead there may be two outlets similarly to there being two inlets and thus the separate fluid flows never combine. Further, there may be any number of passes, sections, inlets, and outlets for a heat exchanger.

As discussed, the heat exchanger sections are configured based on the uneven airflow distribution to increase the heat exchange in areas with increased airflow. Thus, as heat exchange can increase with an increase in refrigerant flow volume, the refrigerant volume of each heat exchanger section may be optimized based on the airflow intensity across each heat exchanger section rather than the same volume for the section. The refrigerant flow is driven by the pressure difference, which in turn is related to the heat transfer. The optimal heat exchanger design achieves substantially identical refrigerant exit states, where the exit state is defined for example by temperature and/or pressure, before the passes are combined. Further, the highest airflow is suited to a section where the temperature difference is low and the heat transfer benefits from a boost, for example a subcooling section in a condenser or a superheating section in an evaporator. The number of tubes in each heat exchanger section 710*a-g* may also depend on the airflow intensity across each heat exchanger section. Heat exchange increases with an increasing number of tubes. Changing the number of tubes in a section also changes the total cross-section area of the section and the amount of the refrigerant flown through the heat exchanger section. Heat exchanger sections 710*a-g* may further include different geometries of tubes and/or fins according to the airflow intensity across each heat exchanger section. Varying tube geometry may include varying one or more of tube density, cross sectional tube shape, tube width, tube height, number of microchannels, microchannel shape, or the like. Varying fin geometry may include varying one or more of fin density, fin height, number of louvers, louver angle, or the like.

Further examples include:

Example 1 is a heat exchanger for receiving an airflow having an uneven intensity distribution across the heat exchanger and for flowing refrigerant within the heat exchanger. The heat exchanger includes sections of microchannel tubes for flowing refrigerant through at least one pass through the heat exchanger, wherein the sections are configured according to the airflow across the heat exchanger.

Example 2 is the heat exchanger of example 1 or any other appropriate example, wherein the number of tubes in each section depends on the airflow intensity across each section.

Example 3 is the heat exchanger of example 1 or any other appropriate example, where the sections comprise fins having different geometries according to the airflow intensity across each section.

Example 4 is the heat exchanger of example 1 or any other appropriate example, wherein the tubes have different geometries according to the airflow intensity across each tube.

Example 5 is the heat exchanger of example 1 or any other appropriate example, wherein non-adjacent sections are configured to flow refrigerant for a pass in the same direction.

Example 6 is the heat exchanger of example 1 or any other appropriate example, wherein two inlets are in fluid communication with two non-adjacent sections for flow in a first pass via a first header.

Example 7 is the heat exchanger of example 6 or any other appropriate example, including two additional sections located between the sections from the first pass for flowing refrigerant in a second pass through the heat exchanger.

Example 8 is the heat exchanger of example 7 or any other appropriate example, including an additional section for a third pass wherein refrigerant from the second pass sections combine into the third pass section and further comprising an outlet in fluid communication with the third pass section via a second header.

Example 9 is the heat exchanger of example 8 or any other appropriate example, further including additional individual sections for flowing refrigerant in additional passes each before flowing refrigerant into the third pass section such that the number of sections and passes from one inlet to the outlet is different than the other.

Example 10 is the heat exchanger of example 7 or any other appropriate example, further including an outlet in fluid communication with the second pass sections via the first header.

Example 11 is the heat exchanger of example 1 or any other appropriate example, wherein the heat exchanger is a condenser.

Example 12 is the heat exchanger of example 11 or any other appropriate example, wherein one of the sections comprises a subcooling section that is positioned to receive the highest airflow intensity in the uneven airflow distribution.

Example 13 is the heat exchanger of example 1 or any other appropriate example, wherein the heat exchanger is an evaporator.

Example 14 is the heat exchanger of example 13 or any other appropriate example, wherein one of the sections comprises a superheating section that is positioned to receive the highest airflow intensity in the uneven airflow distribution.

Example 15 is a heating, ventilation, and air conditioning ("HVAC") system that includes a fan operable to generate an airflow with an uneven intensity distribution. The HVAC system also includes a heat exchanger including sections of microchannel tubes for flowing refrigerant through at least one pass through the heat exchanger, wherein the sections are configured to optimize heat exchange according to the airflow across the heat exchanger.

Example 16 is the HVAC system of example 15 or any other appropriate example, wherein the number of tubes in each section depends on the airflow intensity across each section.

Example 17 is the HVAC system of example 15 or any other appropriate example, wherein the sections include fins having different geometries according to the airflow intensity across each section.

Example 18 is the HVAC system of example 15 or any other appropriate example, wherein the tubes have different geometries according to the airflow intensity across each tube.

Example 19 is the HVAC system of example 15 or any other appropriate example, wherein non-adjacent sections are configured to flow refrigerant for a pass in the same direction.

Example 20 is the HVAC system of example 15 or any other appropriate example, wherein two inlets are in fluid communication with two non-adjacent sections for flow in a first pass via a first header.

Example 21 is the HVAC system of example 20 or any other appropriate example, including two additional sections located between the sections from the first pass for flowing refrigerant in a second pass through the heat exchanger.

Example 22 is the HVAC system of example 21 or any other appropriate example, including an additional section for a third pass wherein refrigerant from the second pass sections combine into the third pass section and further including an outlet in fluid communication with the third pass section via a second header.

Example 23 is the heat exchanger of example 22 or any other appropriate example, further including additional individual sections for flowing refrigerant in additional passes each before flowing refrigerant into the third pass section such that the number of sections and passes from one inlet to the outlet is different than the other.

Example 24 is the HVAC system of example 21 or any other appropriate example, further including an outlet in fluid communication with the second pass sections via the first header.

Example 25 is the HVAC system of example 15 or any other appropriate example, wherein the heat exchanger is a condenser.

Example 26 is the HVAC system of example 25 or any other appropriate example, wherein one of the sections comprises a subcooling section that is positioned to receive the highest airflow intensity in the uneven airflow distribution.

Example 27 is the HVAC system of example 15 or any other appropriate example, wherein the heat exchanger is an evaporator.

Example 28 is the HVAC system of example 27 or any other appropriate example, wherein one of the sections comprises a superheating section that is positioned to receive the highest airflow intensity in the uneven airflow distribution.

Example 29 is the HVAC system of example 15 or any other appropriate example, wherein the fan rotates in a plane parallel to the heat exchanger.

Example 30 is the HVAC system of example 15 or any other appropriate example, wherein the fan rotates in a plane perpendicular to the heat exchanger.

Example 31 is a method of manufacturing a heat exchanger for receiving an airflow having an uneven intensity distribution across the heat exchanger and for flowing refrigerant within the heat exchanger. The method includes constructing a plurality of sections of microchannel tubes for flowing refrigerant through at least one pass through the heat exchanger and configuring the sections according to the airflow across the heat exchanger.

Example 32 is the method of example 31 or any other appropriate example, wherein the configuring comprises selecting the number of tubes in each section depending on the airflow intensity across each section.

Example 33 is the method of example 31 or any other appropriate example, wherein the configuring comprises selecting geometries of fins for each section according to the airflow intensity across each section.

Example 34 is the method of example 31 or any other appropriate example, wherein the configuring comprises selecting geometries of the tubes according to the airflow intensity across each tube.

Example 35 is the method of example 31 or any other appropriate example, wherein the configuring comprises arranging at two sections non-adjacently for a pass in the same direction.

Example 36 is the method of example 31 or any other appropriate example, wherein the configuring comprises providing two inlets in fluid communication with two non-adjacent sections in a first pass via a first header.

Example 37 is the method of example 36 or any other appropriate example, wherein the configuring comprises arranging two additional sections located between the sections from the first pass for flowing refrigerant in a second pass through the heat exchanger.

Example 38 is the method of example 37 or any other appropriate example, wherein the configuring comprises providing an additional section for a third pass wherein refrigerant from the second pass sections combine into the third pass section and further providing an outlet in fluid communication with the third pass section via a second header.

Example 39 is the method of example 38 or any other appropriate example, wherein the configuring further comprises providing additional individual sections for flowing refrigerant in additional passes each before flowing refrigerant into the third pass section such that the number of sections and passes from one inlet to the outlet is different than the other.

Example 40 is the method of example 37 or any other appropriate example, wherein the configuring further comprises providing an outlet in fluid communication with the second pass sections via the first header.

Example 41 is the method of example 31 or any other appropriate example, wherein the constructing comprises configuring the heat exchanger to act as a condenser.

Example 42 is the method of example 41 or any other appropriate example, wherein the configuring comprises configuring one section as a subcooling section and positioning the subcooling section to receive the highest airflow intensity in the uneven airflow distribution.

Example 43 is the method of example 31 or any other appropriate example, wherein the constructing comprises configuring the heat exchanger to act as an evaporator.

Example 44 is the method of example 43 or any other appropriate example, wherein the configuring comprises configuring one section as a superheating section and positioning the superheating section to receive the highest airflow intensity in the uneven airflow distribution.

Certain terms are used throughout the description and claims to refer to particular features or components. As one skilled in the art will appreciate, different persons may refer to the same feature or component by different names. This document does not intend to distinguish between components or features that differ in name but not function.

Reference throughout this specification to "one embodiment," "an embodiment," "embodiments," "some embodiments," "certain embodiments," or similar language means that a particular feature, structure, or characteristic described in connection with the embodiment may be included in at least one embodiment of the present disclosure. Thus, these phrases or similar language throughout this specification may, but do not necessarily, all refer to the same embodiment. Reference to "includes" means, "includes, but is not limited to."

The embodiments disclosed should not be interpreted, or otherwise used, as limiting the scope of the disclosure, including the claims. It is to be fully recognized that the different teachings of the embodiments discussed may be employed separately or in any suitable combination to produce desired results. In addition, one skilled in the art will understand that the description has broad application, and the discussion of any embodiment is meant only to be exemplary of that embodiment, and not intended to suggest that the scope of the disclosure, including the claims, is limited to that embodiment.

What is claimed is:

1. A method of operating a heating, ventilation, and air conditioning (HVAC) system, comprising:

flowing an airflow with an uneven intensity distribution across a heat exchanger; and flowing refrigerant through a plurality of sections of microchannel tubes of the heat exchanger such that the airflow exchanges heat with the refrigerant flowing through the heat exchanger, wherein flowing the refrigerant through the heat exchanger further comprises:

flowing the refrigerant into the heat exchanger, through a first inlet and a second inlet;

flowing the refrigerant from the inlets into first pass sections, which include two non-adjacent sections among the plurality of sections, for flowing the refrigerant in a first pass from a first header to a second header;

flowing the refrigerant from the first pass into second pass sections, which include two additional sections among the plurality of sections located between the first pass sections, for flowing the refrigerant in a second pass from the second header back to the first header;

flowing the refrigerant from the second pass into at least one third pass section among the plurality of sections, for flowing the refrigerant in a third pass from the first header to the second header; and flowing the refrigerant through additional individual sections in additional passes upstream of the third pass such that the number of sections and passes from the first inlet to the third pass is different than the second inlet to the third pass.

2. The method of claim 1, wherein:

flowing the refrigerant in the third pass comprises combining the refrigerant from the second pass sections into one third pass section; and flowing the refrigerant out of the heat exchanger comprises flowing the refrigerant through a first outlet in fluid communication with the third pass section.

3. The method of claim 1, wherein:

flowing the refrigerant in the third pass comprises flowing the refrigerant from the second pass sections into multiple third pass sections; and flowing the refrigerant out of the heat exchanger comprises flowing the refrigerant through a first outlet in fluid communication with one of the third pass sections and a second outlet in fluid communication with another of the third pass sections.

4. The method of claim 1, wherein the sections of microchannel tubes are configured such that the number of microchannel tubes is selected to optimize heat exchange according to the airflow across the heat exchanger.

5. The method of claim 1, where the sections comprise fins having different geometries according to the airflow intensity across each section.

6. The method of claim 1, wherein the microchannel tubes have different geometries according to the airflow intensity across each tube.

7. The method of claim 1, further comprising flowing the refrigerant into the two non-adjacent sections for a pass in the same direction.

8. The method of claim 1, further comprising condensing the refrigerant as the refrigerant flows through the heat exchanger.

9. The method of claim 8, further comprising subcooling the refrigerant in one of the plurality of sections that is positioned to receive the highest airflow intensity in the uneven airflow distribution.

10. The method of claim 1, further comprising evaporating the refrigerant as the refrigerant flows through the heat exchanger.

11. The method of claim 10, further comprising superheating the refrigerant in one of plurality of the sections that is positioned to receive the highest airflow intensity in the uneven airflow distribution.

12. A method of operating a heating, ventilation, and air conditioning (HVAC) system, comprising:

operating a fan to generate an airflow with an uneven intensity distribution across a heat exchanger; and flowing refrigerant through a plurality of sections of microchannel tubes of the heat exchanger such that the airflow exchanges heat with the refrigerant flowing through the heat exchanger, wherein flowing the refrigerant through the heat exchanger further comprises:

flowing the refrigerant into a first header of the heat exchanger through a first inlet and a second inlet;

flowing the refrigerant in a first pass from the first header to a second header of the heat exchanger through two non-adjacent sections among the plurality of sections;

flowing the refrigerant in a second pass from the second header back to the first header through two additional sections among the plurality of sections located between the two non-adjacent sections;

combining the refrigerant from the two additional sections of the second pass and flowing the combined refrigerant in a third pass through an additional section among the plurality of sections;

flowing the combined refrigerant from the third pass section out of the heat exchanger through a first outlet; and flowing the refrigerant in additional passes through additional individual sections disposed upstream the third pass section such that the number of sections and passes from the first inlet to the third pass section is different than the number of sections and passes from the second inlet to the third pass section.

13. The method of claim 12, wherein the additional individual sections comprise:

a first individual section configured to receive refrigerant from one of the two additional sections of the second pass and to flow refrigerant to the second header; and a second individual section configured to receive refrigerant from the first individual section and to flow refrigerant to the first header.

14. The method of claim 12, wherein the number of microchannel tubes in each section depends on the airflow intensity across each section.

15. The method of claim 12, where the sections comprise fins having different geometries according to the airflow intensity across each section.

16. The method of claim 12, wherein the sections of microchannel tubes are configured to optimize heat exchange according to the airflow across the heat exchanger.

17. The method of claim 12, further comprising condensing the refrigerant as the refrigerant flows through the heat exchanger.

18. The method of claim 17, further comprising subcooling the refrigerant in one of the plurality of sections that is positioned to receive the highest airflow intensity in the uneven airflow distribution.

19. The method of claim 12, further comprising evaporating the refrigerant as the refrigerant flows through the heat exchanger.

20. The method of claim 19, further comprising superheating the refrigerant in one of the plurality of sections that is positioned to receive the highest airflow intensity in the uneven airflow distribution.

* * * * *